US010518543B2

(12) United States Patent
Ogawa et al.

(10) Patent No.: US 10,518,543 B2
(45) Date of Patent: Dec. 31, 2019

(54) LIQUID DISCHARGE DEVICE

(71) Applicant: BROTHER KOGYO KABUSHIKI KAISHA, Nagoya-shi, Aichi-ken (JP)

(72) Inventors: Mikio Ogawa, Nagoya (JP); Toshiro Ueda, Inazawa (JP); Kenta Horade, Toukai (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/156,021

(22) Filed: Oct. 10, 2018

(65) Prior Publication Data

US 2019/0105908 A1 Apr. 11, 2019

(30) Foreign Application Priority Data

Oct. 10, 2017 (JP) ..... 2017-197168

(51) Int. Cl.

| | |
|---|---|
| ***B41J 2/175*** | (2006.01) |
| ***B41J 2/045*** | (2006.01) |
| ***B41J 29/13*** | (2006.01) |
| ***B41J 29/38*** | (2006.01) |

(52) U.S. Cl.

CPC ..... *B41J 2/17523* (2013.01); *B41J 2/04563* (2013.01); *B41J 2/04586* (2013.01); *B41J 2/175* (2013.01); *B41J 2/1752* (2013.01); *B41J 2/1753* (2013.01); *B41J 2/17509* (2013.01); *B41J 2/17513* (2013.01); *B41J 2/17546* (2013.01); *B41J 2/17566* (2013.01); *B41J 29/13* (2013.01); *B41J 29/38* (2013.01); *B41J 2002/17573* (2013.01); *B41J 2002/17576* (2013.01)

(58) Field of Classification Search

CPC ..... B41J 2/17523; B41J 2/175; B41J 29/38; B41J 29/13; B41J 2/1753; B41J 2/1752; B41J 2/17513; B41J 2/17509; B41J 2/17546; B41J 2/17566; B41J 2/04563; B41J 2/04586; B41J 2002/17576; B41J 2002/17573

See application file for complete search history.

(56) References Cited

U.S. PATENT DOCUMENTS

| | | | | |
|---|---|---|---|---|
| 2008/0204488 | A1* | 8/2008 | Usui | B41J 2/17513 347/7 |
| 2018/0281396 | A1* | 10/2018 | Morimoto | B41J 2/17509 |
| 2018/0281438 | A1* | 10/2018 | Horade | B41J 2/175 |

FOREIGN PATENT DOCUMENTS

| | | |
|---|---|---|
| JP | 2004-358669 A | 12/2004 |
| JP | 2008-213162 A | 9/2008 |

* cited by examiner

*Primary Examiner* — Yaovi M Ameh
(74) *Attorney, Agent, or Firm* — Merchant & Gould P.C.

(57) ABSTRACT

The liquid discharge device determines a signal received from an installation sensor in response to receiving a discharge instruction, and when determined that a high level signal is received, control executing image recording in a first mode in which a waiting time Tw1 is set, and control executing image recording in a second mode in which a waiting time Tw2 is set.

7 Claims, 13 Drawing Sheets

LIQUID DISCHARGE DEVICE

CROSS-REFERENCE TO RELATED APPLICATION

This application claims priorities from Japanese Patent Application No. 2017-197168 filed on Oct. 10, 2017, the entire subject matters of which is incorporated herein by reference.

TECHNICAL FIELD

The present disclosure relates to a liquid discharge device for discharging a liquid.

BACKGROUND

From the related art, an inkjet printer is known (for example, JP-A-2008-213162) which includes a detachable main tank, a sub tank that stores ink supplied from the installed main tank, and an image recording unit that jets the ink stored in the sub tank and prints an image. In the inkjet printer having the above configuration, internal spaces of the main tank and the sub tank are opened to the air. For this reason, when the main tank is installed in the inkjet printer, the ink moves due to a water head pressure so that the liquid level of the main tank and the liquid level of the sub tank are aligned with the same height by the difference between a water head in the internal space of the main tank and a water head in the internal space of the sub tank (hereinafter, referred to as "water head difference").

Even when the main tank is not installed in the device, if ink is stored in the sub tank, the ink is supplied from the sub tank to the image recording unit, whereby it is possible to execute image recording by the image recording unit. However, depending on the presence or absence of the main tank, the flow path resistance when the ink flows from the sub tank to the image recording unit varies, so that the supply of ink to the image recording unit may be insufficient. As a result, jetting failure of the ink from the image recording unit occurs, and the quality of the recorded image may deteriorate in some cases.

SUMMARY

The present disclosure has been made in view of the above circumstances, and one of objects of the present disclosure is to provide a unit satisfactorily realizing supply of ink to a head even when no cartridge is installed.

According to an illustrative embodiment of the present disclosure, there is provided a liquid discharge device including: an installation case configured to receive a cartridge, the cartridge including: a first liquid chamber storing a liquid; a first flow path, one end of the first flow path communicated with the first liquid chamber, the other end of the first flow path being communicated with an outside of the cartridge; and a second flow path, one end of the second flow path communicated with the first liquid chamber, the other end of the second flow path communicated with the outside of the cartridge; a tank including a second liquid chamber, the tank including: a third flow path, one end of the third flow path communicated with the atmosphere, the other end of the third flow path communicated with the second liquid chamber, at least one of the first flow path and the third flow path configured to communicate with the first liquid chamber of the cartridge installed in the installation case and the second liquid chamber; a fourth flow path, one end of the fourth flow path located below the third flow path communicated with the second liquid chamber; and a fifth flow path, one end of the fifth flow path communicated with the second liquid chamber, the other end of the fifth flow path communicated with the outside of the cartridge; a head communicated with the other end of the fourth flow path; an installation sensor; and a controller. The controller is configured to: determine whether one of a first signal and a second signal is received from the installation sensor, the first signal indicating that the cartridge is not installed in the installation case, the second signal indicating that the cartridge is installed in the installation case; execute a first mode of discharging a liquid through the head, in which a liquid discharge amount through the head per unit time is a first amount in the first mode, based on receiving the discharge instruction to discharge a liquid through the head and determining that the first signal is received; and execute a second mode of discharging a liquid through the head, in which a liquid discharge amount through the head per unit time is a second amount larger than the first amount, based on receiving the discharge instruction to discharge a liquid through the head and determining that the second signal is received.

DETAILED DESCRIPTION

Figure 1A:
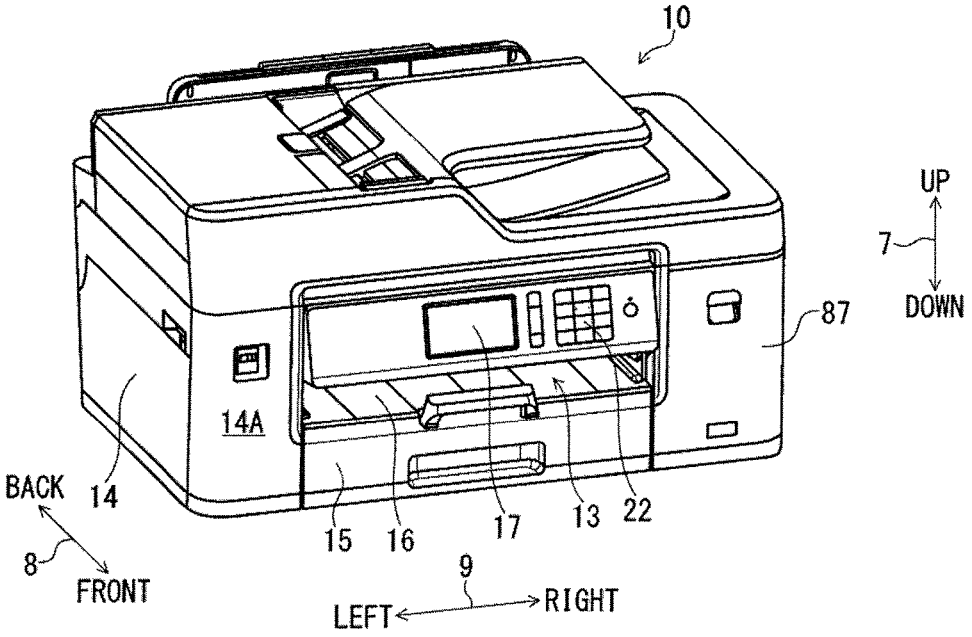
FIG. 1A is an external perspective view of a printer and illustrates a state where a cover is in a covering position.

An embodiment according to the present disclosure will be described below. It is noted that the embodiment described below is merely an example and can be appropriately modified. In addition, an up and down direction 7 is defined with reference to a posture of a printer 10 installed in a horizontal plane in a usable manner, a front and back direction 8 is defined with a surface on which an opening 13 of the printer 10 is formed as a front surface, and a left and right direction 9 is defined when viewing the printer 10 from the front surface. In the embodiment, the up and down direction 7 in the use posture corresponds to a vertical direction, and the front and back direction 8 and the left and right direction 9 correspond to a horizontal direction. The front and back direction 8 and the left and right direction 9 are orthogonal to each other.

[Outline of Printer 10]

The printer 10 according to the embodiment is an example of a liquid discharge device that prints an image on a sheet (an example of a discharge target medium) using an inkjet recording method. The printer 10 has a housing 14 having substantially rectangular parallelepiped shape. Further, the printer 10 may be a so-called "multifunction peripheral" having a facsimile function, a scan function, and a copy function.

Figure 1B:
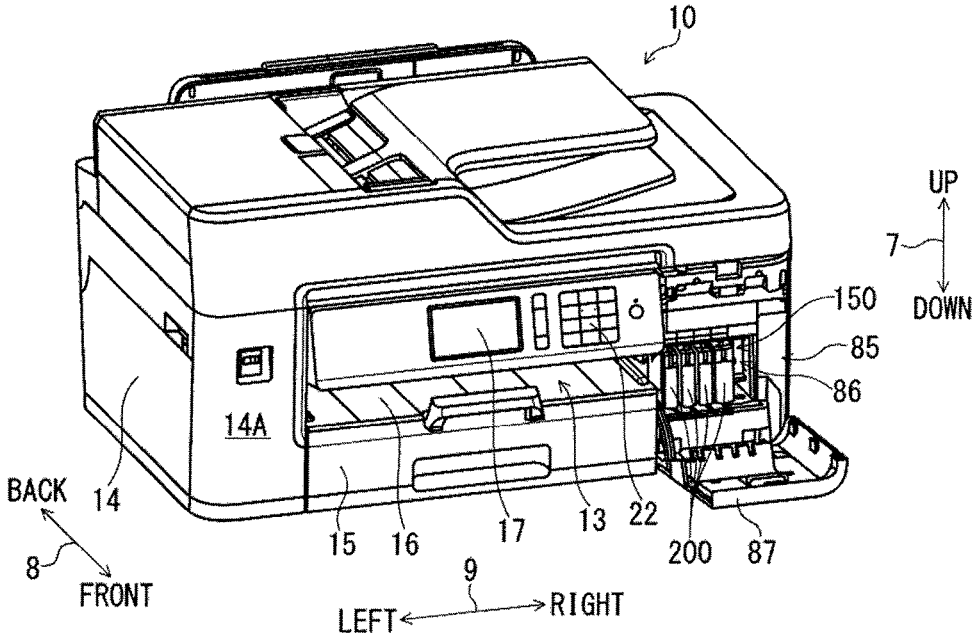
FIG. 1B is an external perspective view of the printer and illustrates a state where the cover is in an exposing position.
Figure 2:
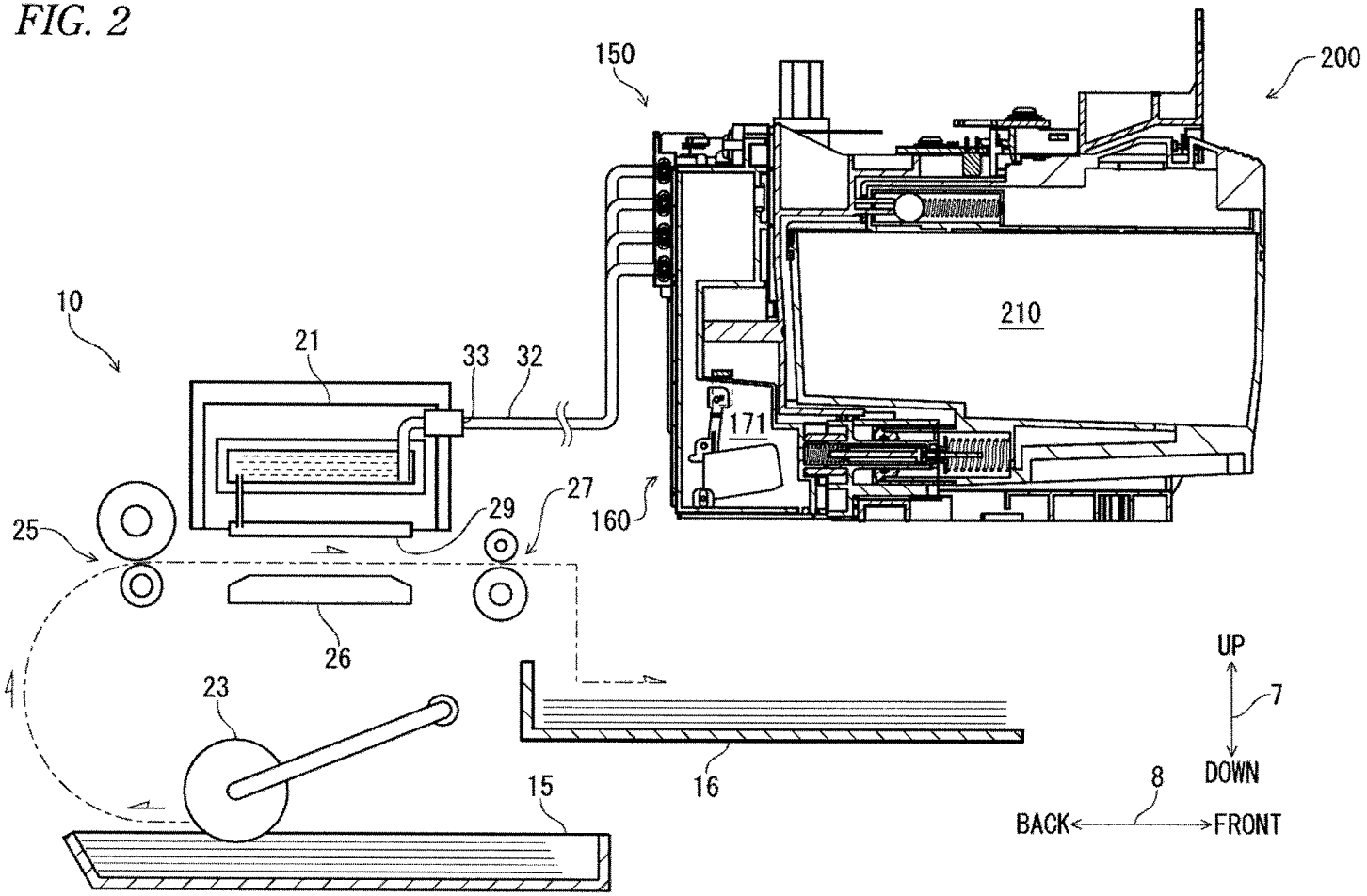
FIG. 2 is a schematic sectional view schematically illustrating an internal structure of the printer.

As illustrated in FIGS. 1A, 1B, and 2, the housing 14 includes therein a feed tray 15, a feed roller 23, a conveyance roller 25, a head 21 including a plurality of nozzles 29, a platen 26 facing the head 21, a discharge roller 27, a discharge tray 16, an installation case 150 to which a cartridge 200 is detachably attached, and a tube 32 for communicating the head 21 with the cartridge 200 installed in the installation case 150.

The printer 10 drives the feed roller 23 and the conveyance roller 25 to convey a sheet supported by the feed tray 15 to the position of the platen 26. Next, the printer 10 discharges an ink, which is supplied from the cartridge 200 installed in the installation case 150 through the tube 32, to the head 21 through the nozzle 29. Thus, the ink is landed on the sheet supported by the platen 26, and an image is recorded on the sheet. Then, the printer 10 drives the discharge roller 27 to discharge the sheet, on which the image is recorded, to the discharge tray 16.

More specifically, the head 21 may be installed in a carriage that reciprocates in a main scanning direction intersecting with the sheet conveyance direction of the sheet by the conveyance roller 25. Then, the printer 10 may cause the head 21 to discharge ink through the nozzle 29 in the course of moving the carriage from one side to the other side in the main scanning direction. Thus, an image is recorded on a partial area of the sheet (hereinafter, referred to as "one pass") facing the head 21. Next, the printer 10 may cause the conveyance roller 25 to convey the sheet so that a next image recording area of the sheet faces the head 21. Then, these processes are alternately and repeatedly executed, and thus an image is recorded on one sheet. In this disclosure, "one pass" is an example of a single unit area.

In the embodiment, the discharge of ink from the nozzle 29 of the head 21 in the image recording is referred to as "jetting", while the discharge of ink from the nozzle 29 of the head 21 in the purging is referred to as "jetting", but the "jetting" is conceptually included in the "discharge".

[Cover 87]

As illustrated in FIGS. 1A and 1B, an opening 85 is formed at a right end in the left and right direction 9 on a front surface 14A of the housing 14. The housing 14 further includes a cover 87. The cover 87 is rotatable between a covering position (a position illustrated in FIG. 1A) at which the opening 85 is covered and an exposing position (a position illustrated in FIG. 1B) at which the opening 85 is exposed. The cover 87 is supported by the housing 14 so as to be rotatable around a rotation axis along the left and right direction 9 in the vicinity of a lower end of the housing in the up and down direction 7, for example. Then, the installation case 150 is located in an accommodating space 86 which is provided inside the housing 14 and spreads backwards from the opening 85.

[Cover Sensor 88]

Figure 6:
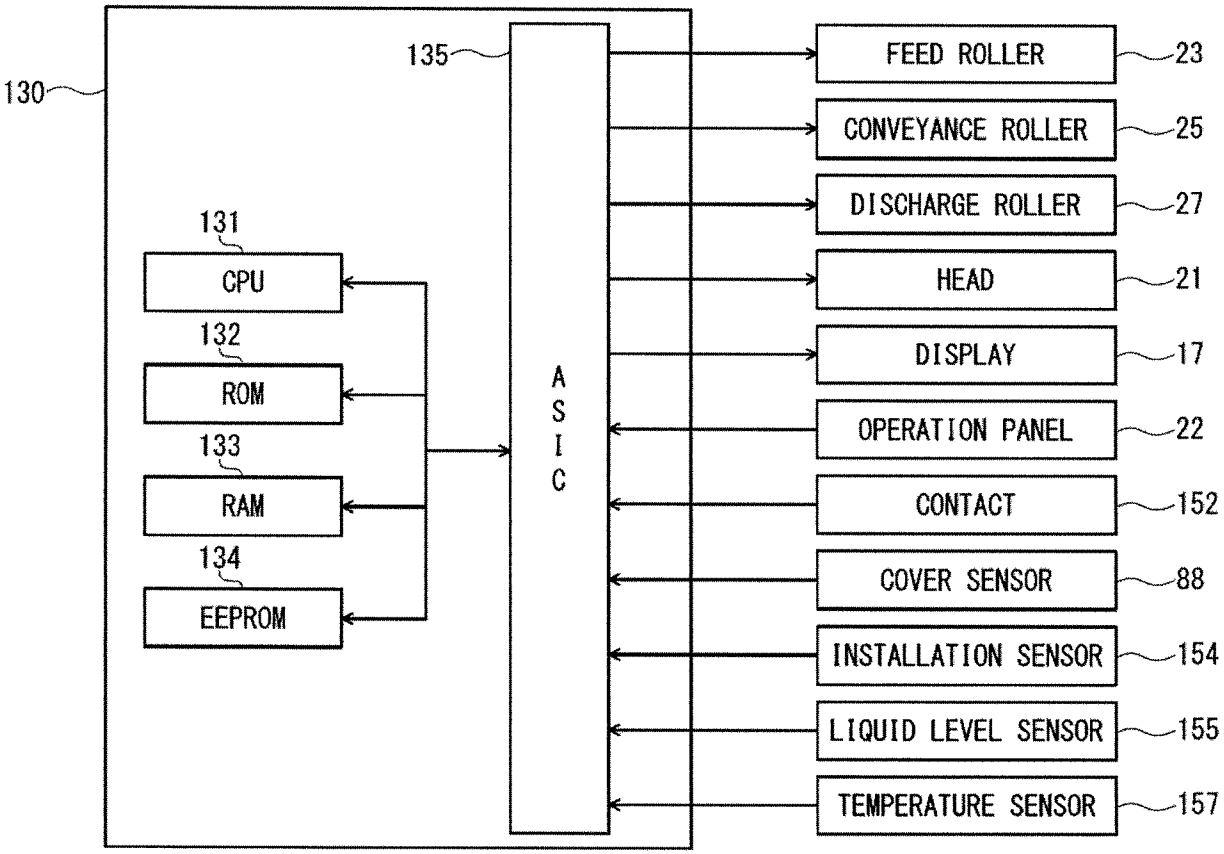
FIG. 6 is a block diagram of the printer.

The printer 10 includes a cover sensor 88 (see FIG. 6). The cover sensor 88 may be, for example, a mechanical sensor such as a switch with and from which the cover 87 contacts and separates, or an optical sensor in which light is blocked or transmitted depending on the position of the cover 87. The cover sensor 88 outputs a signal corresponding to the position of the cover 87 to a controller 130. More specifically, the cover sensor 88 output a low-level signal to the controller 130 when the cover 87 is located at the covering position. On the other hand, the cover sensor 88 outputs a high-level signal having higher signal intensity than the low-level signal to the controller 130 when the cover 87 is located at a position different from the covering position. In other words, the cover sensor 88 outputs the high-level signal to the controller 130 when the cover 87 is located at the exposing position.

[Installation Case 150]

Figure 3:
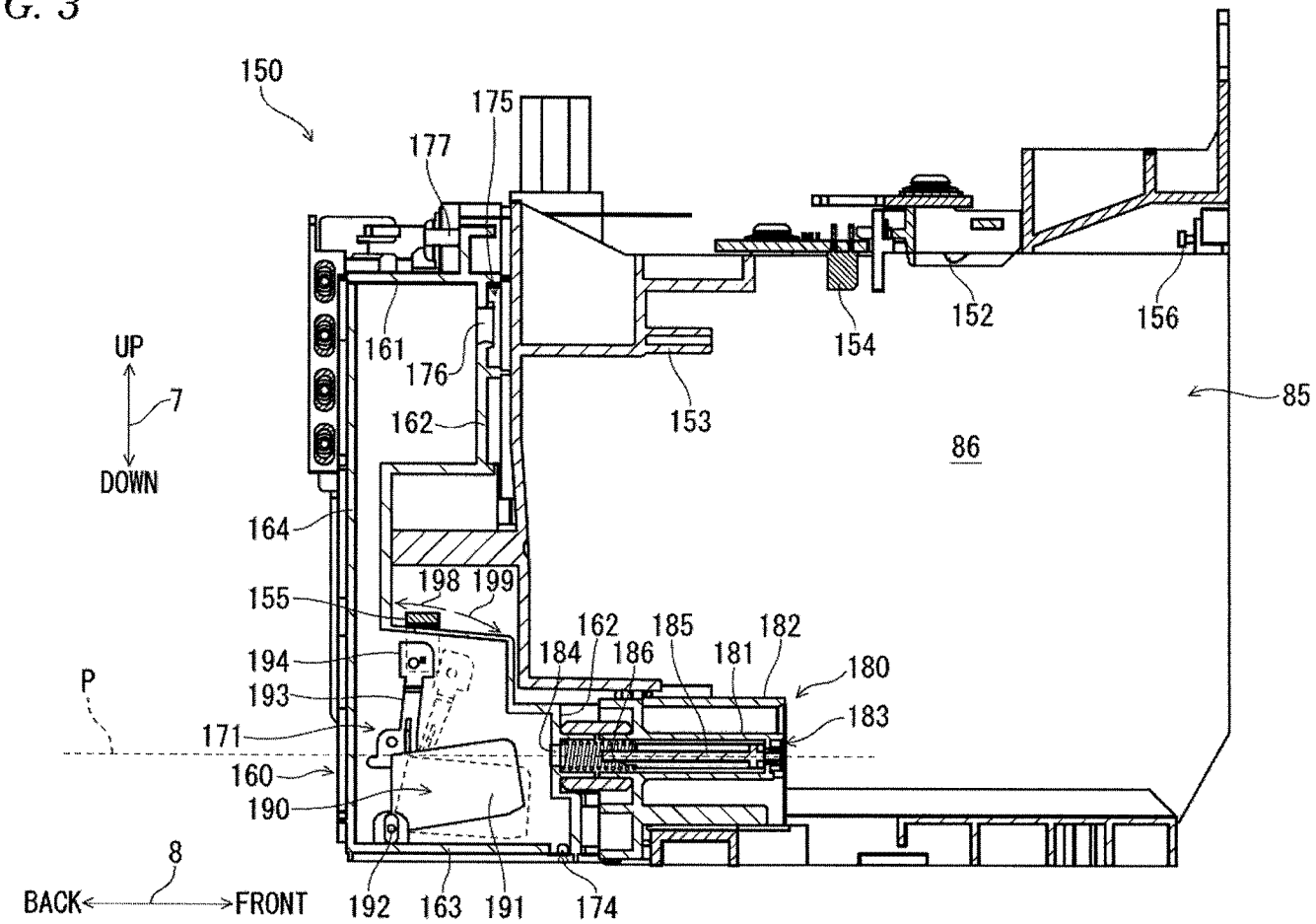
FIG. 3 is a longitudinal sectional view of an installation case.

As illustrated in FIG. 3, the installation case 150 includes a contact 152, a rod 153, an installation sensor 154, a liquid level sensor 155, and a lock pin 156. The installation case 150 can accommodate four cartridges 200 corresponding to respective colors of black, cyan, magenta, and yellow. That is, the installation case 150 includes four contacts 152, four rods 153, four installation sensors 154, and four liquid level sensors 155 corresponding to four cartridges 200. Four cartridges 200 are installed in the installation case 150, but one cartridge or five or more cartridges may be installed.

The installation case 150 has a box shape having an internal space in which the cartridge 200 is accommodated. The internal space of the installation case 150 is defined by a top wall defining an upper end top wall, a bottom wall defining a lower end, an inner wall defining a rear end in the front and back direction 8, and a pair of sidewalls defining both ends in the left and right direction 9. On the other hand, the opening 85 is located to face the inner wall of the installation case 150. That is, the opening 85 exposes the inner space of the installation case 150 to the outside of the printer 10 when the cover 87 is disposed at the exposing position.

Then, the cartridge 200 is inserted into the installation case 150 through the opening 85 of the housing 14, and is pulled out of the installation case 150. More specifically, the cartridge 200 passes backwards through the opening 85 in the front and back direction 8, and is installed in the installation case 150. The cartridge 200 pulled out of the installation case 150 passes forward through the opening 85 in the front and back direction 8.

[Contact 152]

The contact 152 is located on the top wall of the installation case 150. The contact 152 protrudes downwardly toward the internal space of the installation case 150 from the top wall. The contact 152 is located so as to be in contact with an electrode 248 (to be described below) of the cartridge 200 in a state where the cartridge 200 is installed in the installation case 150. The contact 152 has conductivity and is elastically deformable along the up and down direction 7. The contact 152 is electrically connected to the controller 130.

[Rod 153]

The rod 153 protrudes forward from the inner wall of the installation case 150. The rod 153 is located above a joint 180 (to be described below) on the inner wall of the installation case 150. The rod 153 enters an air valve chamber 214 through an air communication port 221 (to be described below) of the cartridge 200 in the course of installing the cartridge 200 on the installation case 150. When the rod 153 enters the air valve chamber 214, the air valve chamber 214 to be described below communicates with the air.

[Installation Sensor 154]

The installation sensor 154 is located on the top wall of the installation case 150. The installation sensor 154 is a sensor for detecting whether the cartridge 200 is installed in the installation case 150. The installation sensor 154 includes a light emitting portion and a light receiving portion which are separated from each other in the left and right direction 9. In the state where the cartridge 200 is installed in the installation case 150, a light shielding rib 245 (to be described below) of the cartridge 200 is located between the light emitting portion and the light receiving portion of the installation sensor 154. In other words, the light emitting portion and the light receiving portion of the installation sensor 154 are located opposite to each other across the light shielding rib 245 of the cartridge 200 installed in the installation case 150.

The installation sensor 154 outputs a different signal (denoted as "installation signal" in the drawings) depending on whether the light irradiated along the left and right direction 9 from the light emitting portion is received by the light receiving portion. The installation sensor 154 outputs a low-level signal (an example of a second signal) to the controller when an intensity of the light received by the light receiving portion is lower than threshold intensity, for example. Meanwhile, the installation sensor 154 outputs a high-level signal (an example of a first signal) having higher signal intensity than the low-level signal to the controller 130 when the intensity of the light received by the light receiving portion is equal to or higher than the threshold intensity.

[Liquid level Sensor 155]

The liquid level sensor 155 is a sensor for detecting whether a detection target portion 194 of an actuator 190 (to be described below) is located at a detection position. The liquid level sensor 155 includes a light emitting portion and a light receiving portion which are separated from each other in the left and right direction 9. In other words, the light emitting portion and the light receiving portion of the liquid level sensor 155 are located opposite to each other across the detection target portion 194 located at the detection position. The liquid level sensor 155 outputs a different signal (denoted as "liquid level signal" in the drawings) depending on whether the light output from the light emitting portion is received by the light receiving portion. The installation sensor 155 outputs a low-level signal to the controller when an intensity of the light received by the light receiving portion is lower than threshold intensity, for example. Meanwhile, the installation sensor 155 outputs a high-level signal having higher signal intensity than the low-level signal to the controller 130 when the intensity of the light received by the light receiving portion is equal to or higher than the threshold intensity.

[Lock Pin 156]

The lock pin 156 is a rod-like member extending along the left and right direction 9 at the upper end of the internal space of the installation case 150 and in the vicinity of the opening 85. Both ends of the lock pin 156 in the left and right direction 9 are fixed to the pair of sidewalls of the installation case 150. The lock pin 156 extends in the left and right direction 9 across four spaces in which four cartridges 200 can be accommodated. The lock pin 156 is used to hold the cartridge 200 installed in the installation case 150 at a installation position illustrated in FIG. 5. The cartridge 200 is engaged with the lock pin 156 in a state of being installed in the installation case 150.

[Tank 160]

The printer 10 includes four tanks 160 corresponding to four cartridges 200. The tank 160 is located backwards from the inner wall of the installation case 150. As illustrated in FIG. 3, the tank 160 includes an upper wall 161, a front wall 162, a lower wall 163, a rear wall 164, and a pair of sidewalls (not illustrated). The front wall 162 includes a plurality of walls which deviate from each other in the front and back direction 8. A liquid chamber 171 is formed inside the tank 160. The liquid chamber 171 is an example of a second liquid chamber.

Among the walls forming the tank 160, at least the wall facing the liquid level sensor 155 has translucency. Thus, the light output from the liquid level sensor 155 can penetrate through the wall facing the liquid level sensor 155. At least a part of the rear wall 164 may be formed of a film welded to the upper wall 161, the lower wall 163, and an end face of the sidewall. In addition, the sidewall of the tank 160 may be common to the installation case 150, or may be independent of the installation case 150. Moreover, the tanks 160 adjacent to each other in the left and right direction 9 are partitioned by a partition wall (not illustrated). Four tanks 160 have substantially the common configuration.

The liquid chamber 171 communicates with an ink flow path (not illustrated) through an outflow port 174. A lower end of the outflow port 174 is defined by the lower wall 163 defining the lower end of the liquid chamber 171. The outflow port 174 is located below the joint 180 (more specifically, a lower end of a through-hole 184) in the up and down direction 7. The ink flow path (not illustrated) communicating with the outflow port 174 communicates with the tube 32 (see FIG. 2). Thus, the liquid chamber 171 communicates with the head 21 from the outflow port 174 through the ink flow path and the tube 32. That is, the ink stored in the liquid chamber 171 is supplied from the outflow port 174 to the head 21 through the ink flow path and the tube 32. Each of the ink flow path and the tube 32 communicating with the outflow port 174 is an example of a fourth flow path in which one end (outflow port 174) communicates with the liquid chamber 171 and the other end 33 (see FIG. 2) communicates with the head 21.

The liquid chamber 171 communicates with the air through an air communication chamber 175. More specifically, the air communication chamber 175 communicates with the liquid chamber 171 through the through-hole 176 penetrating the front wall 162. The through-hole 176 is closed by the semipermeable membrane 178. The semipermeable membrane 178 allows the air to pass therethrough, but does not allow the ink to pass therethrough, or applies larger resistance to the passage of the ink compared to the passage of the air. In addition, the air communication chamber 175 communicates with the outside of the printer 10 through an air communication port 177 and a tube (not illustrated) connected to the air communication port 177. That is, the air communication chamber 175 is an example of a fifth flow path in which one end (through-hole 176) communicates with the liquid chamber 171 and the other end (air communication port 177) communicates with the outside of the printer 10. The air communication chamber 175 communicates with the air through the air communication port 177 and the tube (not illustrated). The flow path resistance Rs in the air communication chamber 175 is mainly resistance of the semipermeable membrane 178.

Joint 180

As illustrated in FIG. 3, the joint 180 includes a needle 181 and a guide 182. The needle 181 is a tube in which a flow path is formed. The needle 181 protrudes forward from the front wall 162 defining the liquid chamber 171. An opening 183 is formed at a protruding tip of the needle 181. In addition, the internal space of the needle 181 communicates with the liquid chamber 171 through a through-hole 184 penetrating the front wall 162. The needle 181 is an example of a third flow path in which one end (opening 183) communicates with the outside of the tank 160 and the other end (through-hole 184) communicates with the liquid chamber 171. The guide 182 is a cylindrical member disposed around the needle 181. The guide 182 protrudes forward from the front wall 162 and has a protruding end which is opened.

In the internal space of the needle 181, a valve 185 and a coil spring 186 are located. In the internal space of the needle 181, the valve 185 is movable between a closed position and an opened position in the front and back direction 8. The valve 185 closes the opening 183 when being positioned at the closed position. Further, the valve 185 opens the opening 183 when being located at the opened position. The coil spring 186 urges the valve 185 in a moving direction from the opened position to the closed position, that is, forward in the front and back direction 8. The valve 185 opens and closes the opening 183 of the needle 181 in conjunction with the installation and uninstallation of the cartridge 200 on the installation case 150.

[Actuator 190]

The actuator 190 is located in the liquid chamber 171. The actuator 190 is supported by a support member (not illustrated) disposed in the liquid chamber 171 so as to be rotatable in directions of arrows 198 and 199. The actuator 190 is rotatable between a position indicated by a solid line in FIG. 3 and a position indicated by a broken line. Further, the actuator 190 is prevented from rotating in the direction of the arrow 198 from the position of the solid line by a stopper (not illustrated; for example, an inner wall of the liquid chamber 171). The actuator 190 includes a float 191, a shaft 192, an arm 193, and a detection target portion 194.

The float 191 is formed of a material having a smaller specific gravity than the ink stored in the liquid chamber 171. The shaft 192 protrudes in the left and right direction 9 from right and left sides of the float 191. The shaft 192 is inserted into a hole (not illustrated) formed in the support member. Thus, the actuator 190 is supported by the support member so as to be rotatable around the shaft 192. The arm 193 extends substantially upwardly from the float 191. The detection target portion 194 is located at a protruding tip of the arm 193. The detection target portion 194 is a plate-like member extending in the up and down direction 7 and the front and back direction 8. The detection target portion 194 is formed of a material or color that shields the light output from the light emitting portion of the liquid level sensor 155.

When a liquid level of the ink stored in the liquid chamber 171 is equal to or higher than a predetermined position P, the actuator 190 rotated in the direction of the arrow 198 by buoyancy is held at the detection position indicated by the solid line in FIG. 3, by the stopper. On the other hand, when the liquid level of the ink is lower than the predetermined position P, the actuator 190 rotates in the direction of the arrow 199 as the liquid level lowers. Thus, the detection target portion 194 moves to a position out of the detection position. That is, the detection target portion 194 moves to a position corresponding to the amount of ink stored in the liquid chamber 171.

The predetermined position P has the same height as an axial center of the needle 181 in the up and down direction 7, and has the same height as a center of an ink supply port 234 (to be described below). However, the predetermined position P is not limited to the position as long as it is located above the outflow port 174 in the up and down direction 7. As another example, the predetermined position P may be a height of the upper end or the lower end of the internal space of the needle 181, or may be a height of an upper end or a lower end of the ink supply port 234.

When the liquid level of the ink stored in the liquid chamber 171 is equal to or higher than the predetermined position P, the light output from the light emitting portion of the liquid level sensor 155 is blocked by the detection target portion 194. Thus, since the light output from the light emitting portion does not reach the light receiving portion, the liquid level sensor 155 outputs a low-level signal to the controller 130. On the other hand, when the liquid level of the ink stored in the liquid chamber 171 is lower than the predetermined position P, since the light output from the light emitting portion reaches the light receiving portion, the liquid level sensor 155 outputs a high-level signal to the controller 130. That is, the controller 130 can detect from the signal output from the liquid level sensor 155 whether the liquid level of the ink stored in the liquid chamber 171 is equal to or higher than the predetermined position P.

[Cartridge 200]

Figure 4A:
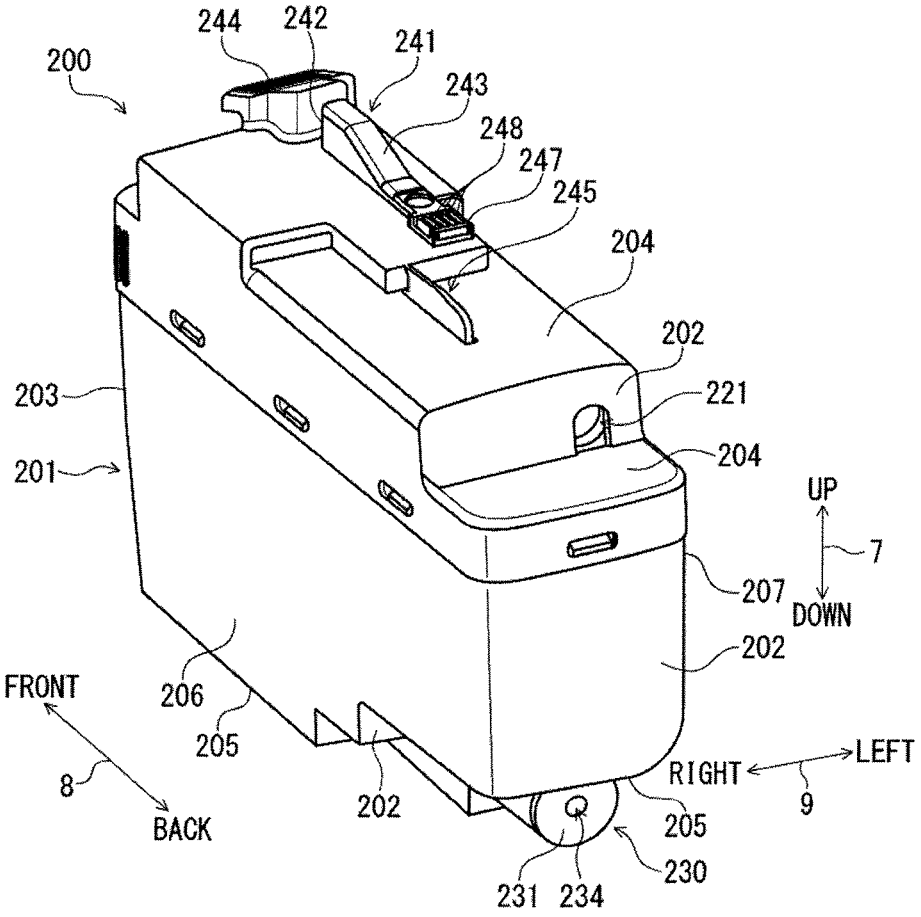
FIG. 4A is a front perspective view illustrating a structure of a cartridge.

The cartridge 200 is a container including a liquid chamber 210 (see FIG. 2) capable of storing ink, which is an example of a liquid, therein. The liquid chamber 210 is defined by a resin wall, for example. As illustrated in FIG. 4A, the cartridge 200 has a flat shape in which dimensions in the up and down direction 7 and the front and back direction 8 are larger than a dimension in the left and right direction 9. The cartridges 200 capable of storing inks of other colors may have the same outer shape or different outer shapes. At least a part of the walls forming the cartridge 200 has translucency. Thus, a user can visually recognize the liquid level of the ink, which is stored in the liquid chamber 210 of the cartridge 200, from the outside of the cartridge 200.

The cartridge 200 includes a housing 201 and a supply tube 230. The housing 201 is formed with a rear wall 202, a front wall 203, an upper wall 204, a lower wall 205, and a pair of sidewalls 206 and 207. The rear wall 202 includes a plurality of walls that deviate from each other in the front and back direction 8. In addition, the upper wall 204 includes a plurality of walls that deviate from each other in the up and down direction 7. Further, the lower wall 205 includes a plurality of walls that deviate from each other in the up and down direction 7.

Figure 4B:
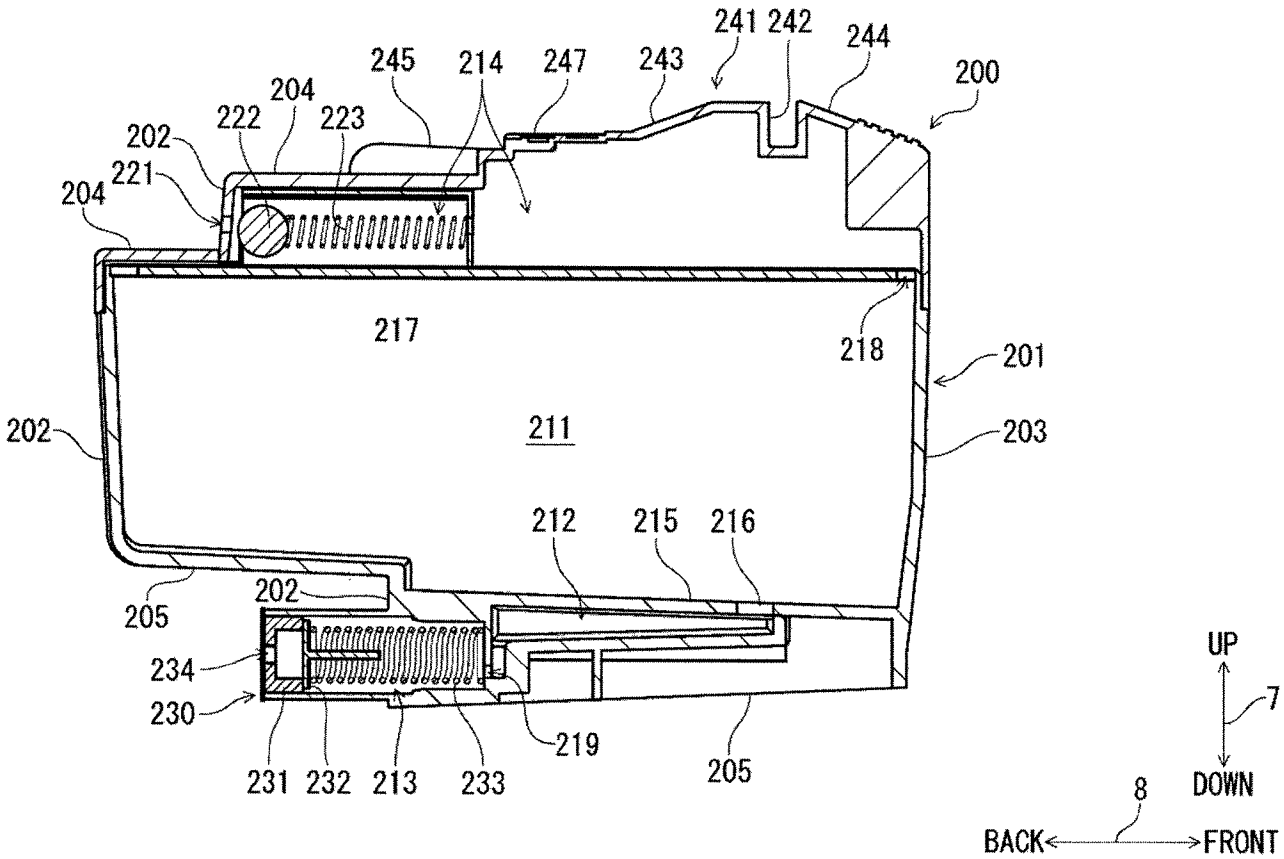
FIG. 4B is a longitudinal sectional view of the cartridge.

In the internal space of the cartridge 200, as illustrated in FIG. 4B, a liquid chamber 210, an ink valve chamber 213, and an air valve chamber 214 are formed. The liquid chamber 210 includes an upper liquid chamber 211 and a lower liquid chamber 212. The upper liquid chamber 211, the lower liquid chamber 212, and the air valve chamber 214 are internal spaces of the housing 201. On the other hand, the ink valve chamber 213 is an internal space of the supply tube 230. The liquid chamber 210 stores ink. The air valve chamber 214 allows the liquid chamber 210 and the outside of the cartridge 200 to communicate with each other. The liquid chamber 210 is an example of a first liquid chamber.

The upper liquid chamber 211 and the lower liquid chamber 212 of the liquid chamber 210 are separated from each other in the up and down direction 7 by a partition wall 215 that partitions the internal space of the housing 201. Then, the upper liquid chamber 211 and the lower liquid chamber 212 communicate with each other through a through-hole 216 formed in the partition wall 215. In addition, the upper liquid chamber 211 and the air valve chamber 214 are separated from each other in the up and down direction 7 by a partition wall 217 that partitions the internal space of the housing 201. Then, the upper liquid chamber 211 and the air valve chamber 214 communicate with each other through a through-hole 218 formed in the partition wall 217. Further, the ink valve chamber 213 communicates with a lower end of the lower liquid chamber 212 through a through-hole 219.

The air valve chamber 214 communicates with the outside of the cartridge 200 through the air communication port 221 formed in the rear wall 202 at the upper part of the cartridge 200. That is, the air valve chamber 214 is an example of a second flow path in which one end (through-hole 218) communicates with the liquid chamber 210 (more specifically, the upper liquid chamber 211) and the other end (air communication port 221) communicates with the outside of the cartridge 200. The air valve chamber 214 communicates with the air through the air communication port 221. In addition, a valve 222 and a coil spring 223 are located in the air valve chamber 214. The valve 222 is movable between a closed position and an opened position in the front and back direction 8. When being located at the closed position, the valve 222 closes the air communication port 221. Further, when being located at the opened position, the valve 222 opens the air communication port 221. The coil spring 223 urges the valve 222 in a moving direction from the opened position to the closed position, that is, backward in the front and back direction 8.

The air valve chamber 214 is divided into two rooms in the front and back direction 8 by the partition wall 224. The room located on the rear side in the front and back direction 8 is provided with the valve 222 and the coil spring 223, and communicates with the outside through the air communication port 221. The room located on the front side in the front and back direction 8 communicates with the upper liquid chamber 211 through the through-hole 218. The partition wall 224 is formed with the through-hole 225. The through-hole 225 communicates with the two rooms divided in the front and back direction 8. The through-hole 225 is closed by the semipermeable membrane 226. The semipermeable membrane 226 allows the air to pass therethrough, but does not allow the ink to pass therethrough, or applies larger resistance to the passage of the ink compared to the passage of the air. The flow path resistance Rc in the air valve chamber 214 corresponds mainly to the resistance of the semipermeable membrane 226. The flow path resistance Rc in the air valve chamber 214 is smaller than the flow path resistance Rs in the air communication chamber 175 (refer to FIG. 5) (Rc<Rs).

Figure 5:
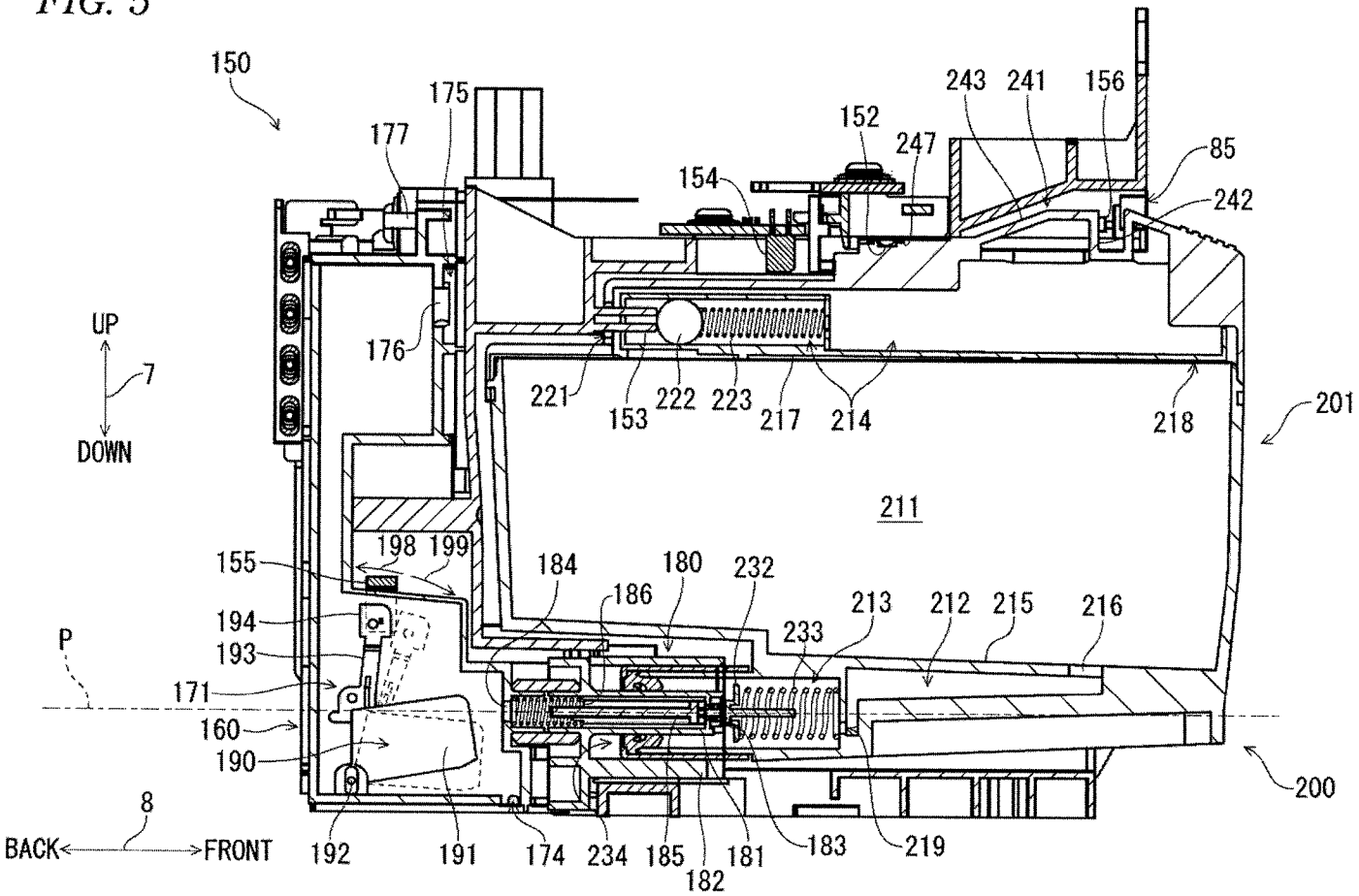
FIG. 5 is a longitudinal sectional view illustrating a state where the cartridge is installed in the installation case.

As illustrated in FIG. 5, in the course of installing the cartridge 200 on the installation case 150, the rod 153 enters the inside of the air valve chamber 214 through the air communication port 221. The rod 153 having entered the air valve chamber 214 moves forward the valve 222 located at the closed position against an urging force of the coil spring 223. Then, the valve 222 moves to the opened position, and thus the upper liquid chamber 211 communicates with the air. The configuration for opening the air communication port 221 is not limited to the above example. As another example, a configuration may be adopted in which the rod 153 breaks through a film that seals the air communication port 221.

The supply tube 230 protrudes backward from the rear wall 202 in the lower part of the housing 201. The protruding end (that is, a rear end) of the supply tube 230 is opened. That is, the ink valve chamber 213 allows the liquid chamber 210 communicating through the through-hole 219 and the outside of the cartridge 200 to communicate with each other. The ink valve chamber 213 is an example of a first flow path in which one end (through-hole 219) communicates with the liquid chamber 210 (more specifically, the lower liquid chamber 212) and the other end (an ink supply port 234 which will be described below) communicates with the outside of the cartridge 200. In the ink valve chamber 213, a packing 231, a valve 232, and a coil spring 233 are located.

At the center of the packing 231, an ink supply port 234 penetrating in the front and back direction 8 is formed. An inner diameter of the ink supply port 234 is slightly smaller than an outer diameter of the needle 181. The valve 232 is movable between a closed position and an opened position in the front and back direction 8. When being located at the closed position, the valve 232 comes in contact with the packing 231 and closes the ink supply port 234. Further, when being located at the opened position, the valve 232 separates from the packing 231 and opens the ink supply port 234. The coil spring 233 urges backward the valve 232 in a moving direction from the opened position to the closed position, that is, the front and back direction 8. In addition, the urging force of the coil spring 233 is larger than that of the coil spring 186.

The supply tube 230 enters the guide 182 in the course of installing the cartridge 200 on the installation case 150, and the needle 181 eventually enters the ink valve chamber 213 through the ink supply port 234. At this time, the needle 181 makes liquid-tight contact with the inner peripheral surface defining the ink supply port 234 while elastically deforming the packing 231. When the cartridge 200 is further inserted into the installation case 150, the needle 181 moves forward the valve 232 against an urging force of the coil spring 233. In addition, the valve 232 moves backward the valve 185 protruding from the opening 183 of the needle 181 against the urging force of the coil spring 186.

Thus, as illustrated in FIG. 5, the ink supply port 234 and the opening 183 are opened, and the ink valve chamber 213 of the supply tube 230 communicates with the internal space of the needle 181. That is, in the state where the cartridge 200 is installed in the installation case 150, the ink valve chamber 213 and the internal space of the needle 181 form a flow path through which the liquid chamber 210 of the cartridge 200 communicates with the liquid chamber 171 of the tank 160.

In the state where the cartridge 200 is installed in the installation case 150, a part of the liquid chamber 210 and a part of the liquid chamber 171 overlap each other when viewed in the horizontal direction. As a result, the ink stored in the liquid chamber 210 moves to the liquid chamber 171 of the tank 160 due to a water head difference through the connected supply tube 230 and the joint 180.

As illustrated in FIG. 4, a projection 241 is formed on the upper wall 204. The projection 241 protrudes upward from the outer surface of the upper wall 204 and extends in the front and back direction 8. The projection 241 includes a lock surface 242 and an inclined surface 243. The lock surface 242 and the inclined surface 243 are located above the upper wall 204. The lock surface 242 is directed to the front side in the front and back direction 8 and extends in the up and down direction 7 and the left and right direction 9 (that is, being substantially orthogonal to the upper wall 204). The inclined surface 243 is inclined with respect to the upper wall so as to be directed upward in the up and down direction 7 and backward in the front and back direction 8.

The lock surface 242 is a surface to be brought into contact with the lock pin 156 in the state where the cartridge 200 is installed in the installation case 150. The inclined surface 243 is a surface for guiding the lock pin 156 to a position where the lock pin comes in contact with the lock surface 242 in the course of installing the cartridge 200 on the installation case 150. In the state where the lock surface 242 and the lock pin 156 are in contact with each other, the cartridge 200 is held at the installation position illustrated in FIG. 5 against the urging force of the coil springs 186, 223, and 233.

A flat plate-like member is formed in front of the lock surface 242 so as to extend upward from the upper wall 204. An upper surface of the flat plate-like member corresponds to an operation portion 244 to be operated by a user when the cartridge 200 is removed from the installation case 150. When the cartridge 200 is installed in the installation case 150 and the cover 87 is located at the exposing position, the operation portion 244 can be operated by the user. When the operation portion 244 is pushed downward, the cartridge 200 rotates, and thus the lock surface 242 moves downward from the lock pin 156. As a result, the cartridge 200 can be removed from the installation case 150.

The light shielding rib 245 is formed on the outer surface of the upper wall 204 and behind the projection 241. The light shielding rib 245 protrudes upward from the outer surface of the upper wall 204 and extends in the front and back direction 8. The light shielding rib 245 is formed of a material or color that shields the light output from the light emitting portion of the installation sensor 154. The light shielding rib 245 is located on an optical path extending from the light emitting portion to the light receiving portion of the installation sensor 154 in the state where the cartridge 200 is installed in the installation case 150. That is, the installation sensor 154 outputs a low-level signal to the controller 130 when the cartridge 200 is installed in the installation case 150. On the other hand, the installation sensor 154 outputs a high-level signal to the controller 130 when the cartridge 200 is not installed in the installation case 150. That is, the controller 130 can detect whether the cartridge 200 is installed in the installation case 150, depending on a signal output from the installation sensor 154.

An IC substrate 247 is located on the outer surface of the upper wall 204 and between the light shielding rib 245 and the projection 241 in the front and back direction 8. On the IC substrate 247, an electrode 248 is formed. In addition, the IC substrate 247 includes a memory (not illustrated). The electrode 248 is electrically connected to the memory of the IC substrate 247. The electrode 248 is exposed on an upper surface of the IC substrate 247 so as to be electrically connectable with the contact 152. That is, the electrode 248 is electrically connected to the contact 152 in the state where the cartridge 200 is installed in the installation case 150. The controller 130 can read information from the memory of the IC substrate 247 through the contact 152 and the electrode 248, and can write information to the memory of the IC substrate 247 through the contact 152 and the electrode 248.

[Controller 130]

As illustrated in FIG. 6, the controller 130 includes a CPU 131, a ROM 132, a RAM 133, an EEPROM 134, and an ASIC 135. The ROM 132 stores various programs that allow the CPU 131 to control various operations. The RAM 133 is used as a storage region which temporarily records data or signals to be used when the CPU 131 executes the programs or a work region where data is processed. The EEPROM 134 stores setting information which should be retained even after the power is turned off. The ROM 132, the RAM 133, and the EEPROM 134 are examples of a memory.

The ASIC 135 is used to operate the feed roller 23, the conveyance roller 25, the discharge roller 27, and the head 21. The controller 130 rotates the feed roller 23, the conveyance roller 25, and the discharge roller 27 by driving a motor (not illustrated) through the ASIC 135. In addition, the controller 130 outputs a driving signal to a driving element of the head 21 through the ASIC 135, thereby causing the head 21 to discharge ink through the nozzle 29. The ASIC 135 can output a plurality types of driving signals depending on the amount of ink to be discharged through the nozzle 29.

Further, a display 17 and an operation panel 22 are connected to the ASIC 135. The display 17 is a liquid crystal display, an organic EL display, or the like, and includes a display screen on which various types of information are displayed. The display 17 is an example of a notification device. However, specific examples of the notification device are not limited to the display 17, and may include a speaker, an LED lamp, or a combination thereof. The operation panel 22 outputs an operation signal corresponding a user's operation to the controller 130. For example, the operation panel 22 may include a push button, or may include a touch sensor overlaid on the display 17.

Further, the ASIC 135 is electrically connected with the contact 152, the cover sensor 88, the installation sensor 154, the liquid level sensor 155, and the temperature sensor 157. The temperature sensor 157 outputs an electric signal according to an environmental temperature at which the printer 10 is set. The controller 130 accesses the memory of the IC substrate 247 of the cartridge 200 installed in the installation case 150 through the contact 152. The controller 130 detects the position of the cover 87 through the cover sensor 88. In addition, the controller 130 detects insertion and removal of the cartridge 200 through the installation sensor 154. Further, the controller 130 detects through the liquid level sensor 155 whether the liquid level of the ink stored in the liquid chamber 171 is equal to or higher than the predetermined position P.

The EEPROM 134 stores various types of information in correlation with four cartridges 200 installed in the installation case 150, namely, in correlation with the tanks 160 communicating with the cartridges 200. The various types of information include, for example, waiting times Tw1, Tw2, and Tw3 between passes, a threshold Th, and the like in each mode for image recording.

[Operation of Printer 10]

Figure 7:
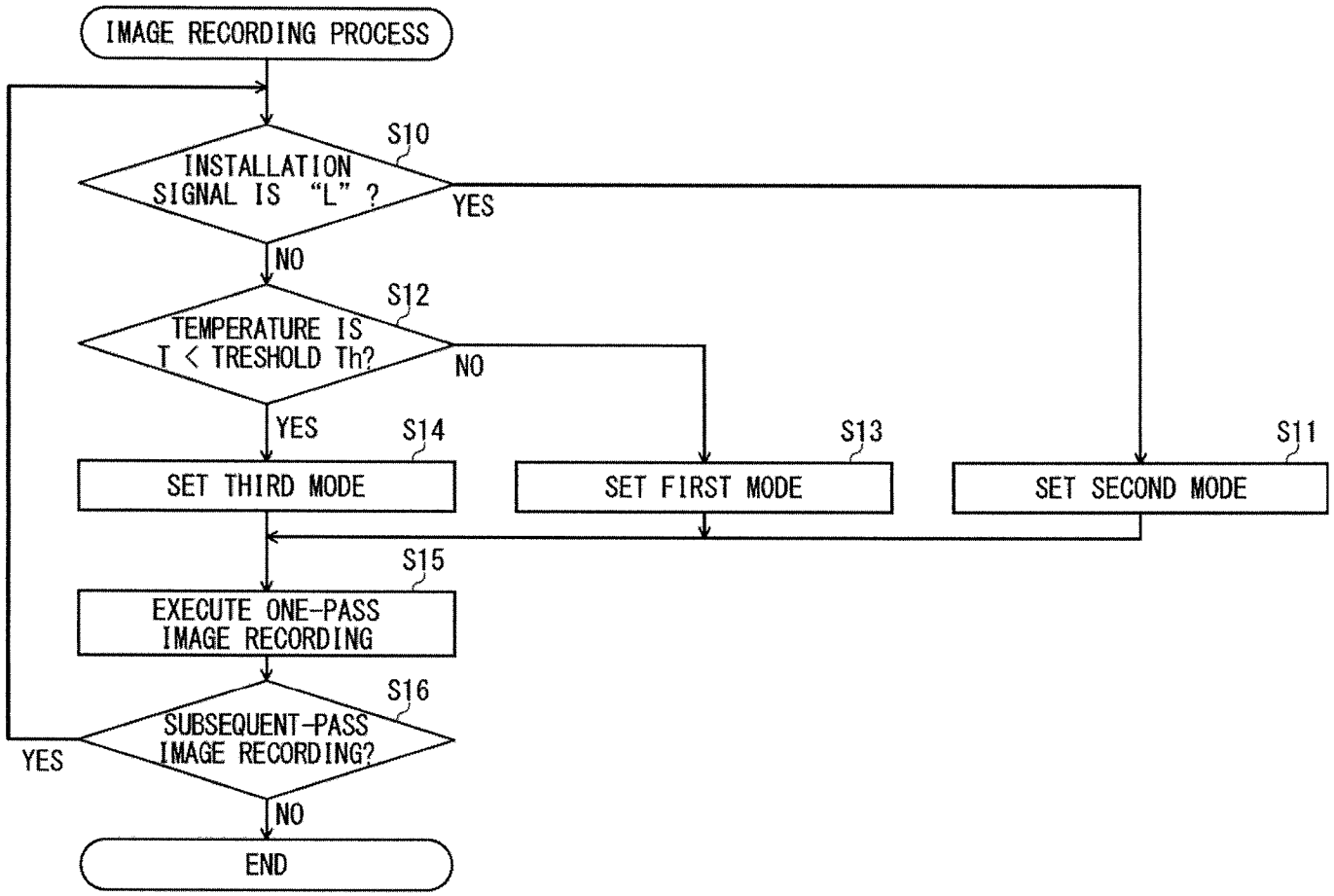
FIG. 7 is a flowchart of an image recording process.

An operation of the printer 10 according to the embodiment will be described with reference to FIG. 7. Each of processes illustrated in FIG. 7 is executed by the CPU 131 of the controller 130. Each of the following processes may be executed by the CPU 131 reading programs stored in the ROM 132, or may be implemented by a hardware circuit installed in the controller 130. Further, execution orders of the following processes can be appropriately changed.

[Image Recording Process]

The controller 130 executes an image recording process in response to receiving a recording instruction. The recording instruction may be to execute image recording of a plurality of pages. However, in the following description, in a case of an image recording process of one page will be described. For the case of image recording of a plurality of pages, the following image recording process is executed repeatedly.

The controller 130 executes an image recording process illustrated in FIG. 7 in response to a recording instruction being input to the printer 10. The recording instruction is an example of a discharge instruction for causing the printer 10 to execute a recording process of recording an image indicated by image data on a sheet. An acquisition destination of the recording instruction is not particularly limited, but, for example, a user's operation corresponding to the recording instruction may be received through the operation panel 22 or may be received from an external device through a communication interface (not illustrated).

Figure 8A:
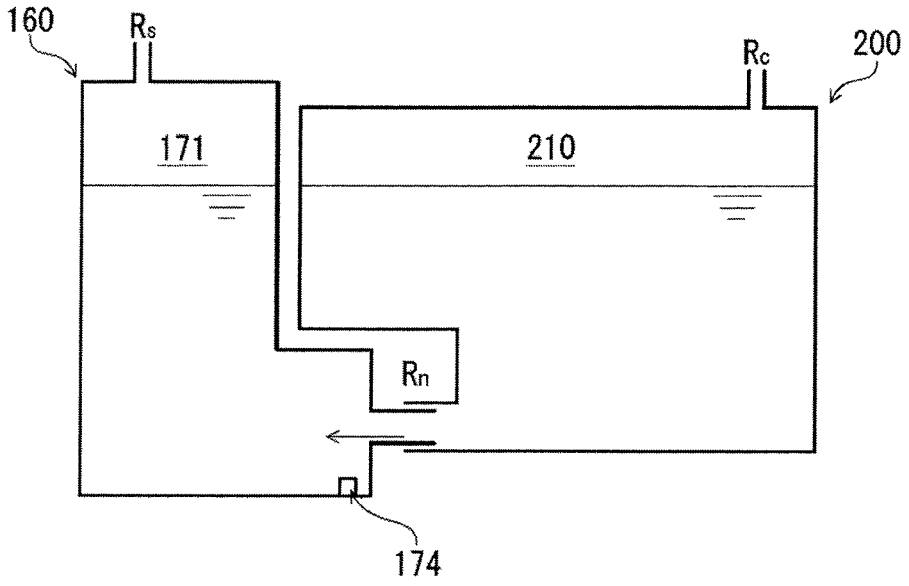
FIG. 8A is a schematic view illustrating a state where the cartridge is installed in the installation case.

The controller 130 received the recording instruction determines whether the signal received from the installation sensor 154 is a low-level signal (S10). As illustrated in FIG. 8A, in the state where the cartridge 200 is installed in the installation case 150, the installation sensor 154 outputs a low-level signal. The controller 130 sets a second mode (S11) in response to receiving the low-level signal from the installation sensor 154, and executes one-pass image recording (S15).

Figure 8B:
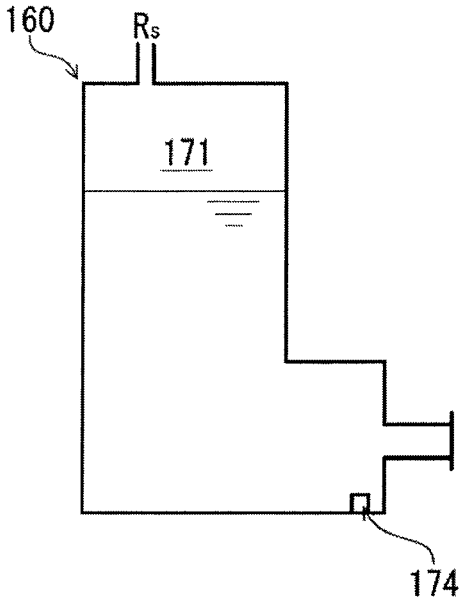
FIG. 8B is a schematic view illustrating a state where the cartridge is not installed in the installation case.

As illustrated in FIG. 8B, if the cartridge 200 is not installed in the installation case 150, the installation sensor 154 outputs a high-level signal. The controller 130, in response to receiving the high-level signal from the installation sensor 154 (S10: No), determines whether a temperature T based on the signal received from the temperature sensor 157 is lower than the threshold Th (S12). The controller 130, in response to determining that the temperature T is equal to or higher than the threshold Th (S12: No), sets a first mode (S13), and executes one-pass image recording (S15).

The controller 130, in response to determining that the temperature T is lower than the threshold Th (S12: Yes), sets a third mode (S16), and executes one-pass image recording (S15). Then, the controller 130 determines whether there is image recording to be executed corresponding to a subsequent pass (S16), and repeatedly executes image recording of processes from S10 to S15 in response to determining that there is subsequent-pass image recording to be executed (S16: Yes). The controller 130 ends image recording for one page in response to determining that there is no subsequent-pass image recording to be executed (S16: No).

Modes

Each mode set in the processes of S11, S13, and S14 is different from each other in a one-pass image recording rate (an example of a discharge rate of a liquid through the head per unit time) due to the difference in a waiting time between one-pass image recording and subsequent-pass image recording.

The controller 130 sets a waiting time Tw1 (an example of a first time) in the first mode. The controller 130 sets a waiting time Tw2 (an example of a second time) in the second mode. The controller 130 sets a waiting time Tw3 in the third mode. The waiting time Tw1 is longer than the waiting time Tw2. The waiting time Tw3 is longer than the waiting time Tw1. That is, respective waiting times are the waiting time Tw2, the waiting time Tw1, and the waiting time Tw3 from the shortest order (Tw2<Tw1<Tw3).

As illustrated in FIG. 8B, the first mode is set when the cartridge 200 is not installed in the installation case 150 and the temperature T is equal to or higher than the threshold Th. Even when the cartridge 200 is not installed in the installation case 150, if sufficient amount of ink is stored in the liquid chamber 171 of the tank 160, it is possible to execute image recording by supplying ink from the liquid chamber 171 to the head 21.

As illustrated in FIG. 8A, the second mode is set when the cartridge 200 is installed in the installation case 150. When the cartridge 200 is installed in the installation case 150, ink is supplied from the liquid chamber 210 of the cartridge 200 to the liquid chamber 171 of the tank 160, and further the ink is supplied from the liquid chamber 171 to the head 21, whereby it is possible to execute image recording.

In the state where the cartridge 200 is installed in the installation case 150, when ink is discharged from the head 21, the ink flows from the liquid chamber 210 and the liquid chamber 171 to the head 21. When ink flows out from the liquid chamber 210 and the liquid chamber 171, the air enters the liquid chamber 210 and the liquid chamber 171. The flow path resistance Rc in the air valve chamber 214 acts on the air entering the liquid chamber 210. The flow path resistance Rs in the air communication chamber 175 acts on the air entering the liquid chamber 171. Since the flow path resistances Rc and Rs act on in parallel, in the liquid chamber 210 and the liquid chamber 171 as a whole, the flow path resistance Ra which is the total value of the flow resistances with respect to the entry of air is as follows.

$$1/Ra=1/Rc+1/Rs$$

When ink flows out from the liquid chamber 210 to the liquid chamber 171, the flow path resistance Rn due to the needle 181 acts on. Therefore, the total flow path resistance R1 acting on when ink flows out from the liquid chamber 210 to the liquid chamber 171 is a total value of the flow path resistance Ra and the flow path resistance Rn.

$$R1=Ra+Rn$$

In the state where the cartridge 200 is not installed in the installation case 150, when ink is discharged from the head 21, the ink flows from the liquid chamber 171 to the head 21. At this time, the flow path resistance Rs in the air communication chamber 175 acts on the air entering the liquid chamber 171. On the other hand, the flow path resistance Rc in the air valve chamber 214 and the flow path resistance Rn of the needle 181 do not act on. Therefore, in the state where the cartridge 200 is not installed in the installation case 150, the total flow path resistance R2 when ink is discharged from the head 21 is equivalent to the flow path resistance Rs (R2=Rs).

Here, in the state where the cartridge 200 is installed in the installation case 150, when ink is discharged from the head 21, it is assumed that each flow path resistance is set such that the consumption of ink stored in the liquid chamber 210 is larger than the consumption of ink stored in the liquid chamber 171. That is, compared to the sum of the flow path resistance Rc and the flow path resistance Rn which are flow path resistances when ink flows out from the liquid chamber 210, the flow path resistance Rs which is the flow path resistance when the ink flows out from the liquid chamber 171 is large (Rs>(Rc+Rn)). In addition, the flow path resistance Rs is larger than the flow path resistance Rc (Rs>Rc).

Accordingly, if the flow path resistance Rc is a positive value, the total flow path resistance R2 becomes greater than the total flow path resistance R1. Therefore, compared to the state where the cartridge 200 is installed in the installation case 150, the flow path resistance with respect to the discharging of ink from the head 21 becomes large in the case of the state where the cartridge 200 is not installed in the installation case 150. As a result, it becomes difficult to supply ink from the liquid chamber 171 to the head 21 in the case of the state where the cartridge 200 is not installed in the installation case 150, as compared to the state where the cartridge 200 is installed in the installation case 150.

If it is difficult to supply ink from the liquid chamber 171 to the head 21, the supply of ink is insufficient in the head 21, thereby occurring jetting failure of ink from the head 21, for example. Since the waiting time Tw1 is longer than the waiting time Tw2, the discharge rate (an example of a first rate) of ink to be discharged from the head 21 in the first mode becomes slower than the discharge rate (an example of a second rate) of ink to be discharged from the head 21 in the second mode, while executing image recording for one page realized through image recording in plural passes.

As the temperature T is lowered, the viscosity of ink tends to be lowered. Accordingly, compared to the case where the temperature T is equal to or higher than the threshold Th, the viscosity of ink is lower in the case where the temperature T is lower than the threshold Th. As the viscosity of ink is lowered, it is difficult to supply the ink from the liquid chamber 171 to the head 21. Since the waiting time Tw3 is longer than the waiting time Tw1, the discharge rate (an example of a third rate) of ink to be discharged from the head 21 in the third mode is slower than the discharge rate of ink to be discharged from the head 21 in the second mode in image recording for one page realized through image recording in plural passes.

[Operational Effect]

According to the embodiment described above, since the waiting time Tw2 (second mode) is set in the state where the cartridge 200 is installed in the installation case 150 and the waiting time Tw1 (first mode), which is longer than the waiting time Tw2, is set in the state where the cartridge 200 is not installed in the installation case 150, a risk that the amount of a liquid to be supplied from the liquid chamber 171 to the head 21 is insufficient can be reduced.

Since the flow path resistance Rc is smaller than the flow path resistance Rs, in the state where the cartridge 200 is installed in the installation case 150, the air is likely to enter the liquid chamber 210 of the cartridge 200 compared to the liquid chamber 171 of the tank 160 as a liquid is discharged from the head 21. Therefore, the ink stored in the liquid chamber 210 is preferentially consumed, thereby reducing a risk that the air enters the head 21 from the liquid chamber 171. Meanwhile, in the state where the cartridge 200 is not installed in the installation case 150, since the air enters the liquid chamber 171 through relatively large flow path resistance Rs, as a liquid is discharged from the head 21, the risk that the amount of the liquid to be supplied to the head 21 from the liquid chamber 171 is insufficient becomes high. However, the waiting time Tw is set which is longer than the waiting time Tw2, and the discharge rate of ink becomes slow, thereby reducing a risk that the air enters the head 21 from the liquid chamber 171.

Since the flow path of the air communication chamber 175 in the tank 160 is closed with the semipermeable membrane 178, and the flow path of the air valve chamber 214 in the cartridge 200 is closed with semipermeable membrane 226, it is prevented that the ink flows out to the outside from the liquid chamber 171 and the liquid chamber 210.

Since the waiting time is changed in each mode, and the discharge rate of ink during imaging recording for one sheet is changed, it is not necessary to change the discharge rate of ink to be discharged during one-pass image recording. Therefore, in all the modes, for example, it is possible to keep the frequency at which ink is discharged from the head 21 constant or to make the movement speed of the head 21 in the main scanning direction constant.

Since the signal received from the installation sensor 154 is determined whenever executing one-pass image recording, it is possible to change the mode for each pass. As a result, when the cartridge 200 is installed in the installation case 150 in the middle of image recording, it is possible to generally improve the image recording rate by changing the mode from the first mode to the second mode.

Since the first mode or the third mode is set based on the temperature detected by the temperature sensor 157, even when the environmental temperature, at which the printer 10 is set, is low and the viscosity of ink is high, a risk that the amount of ink to be supplied from the liquid chamber 171 to the head 21 is insufficient is reduced.

[Modification]

In the embodiment described above, the waiting time is changed for each mode. Instead of this, one-pass image recording may be executed such that the waiting time between passes is set to be fixed, and one-pass image recording is set to be batch-executed in the second mode and set to a divided pass (an example of a divided area) by dividing the one-pass image recording in plural parts (for example, two parts) in the first mode, for example, such that the carriage installed with the head 21 is moved plural times (for example, two times) in the main scanning direction.

Figure 9A:
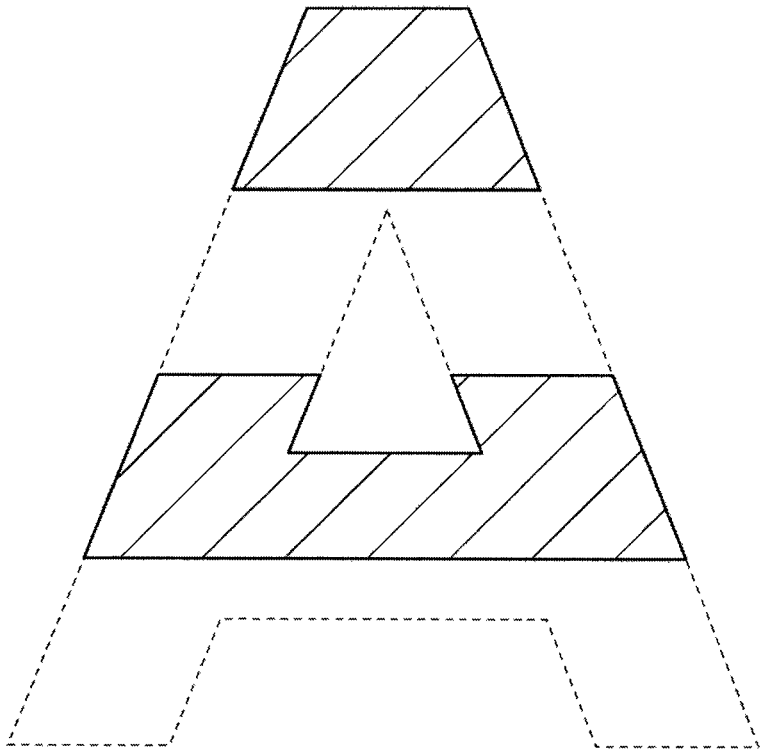
FIGS. 9A and 9B are views illustrating an example of image recording in a divided pass.
Figure 9B:
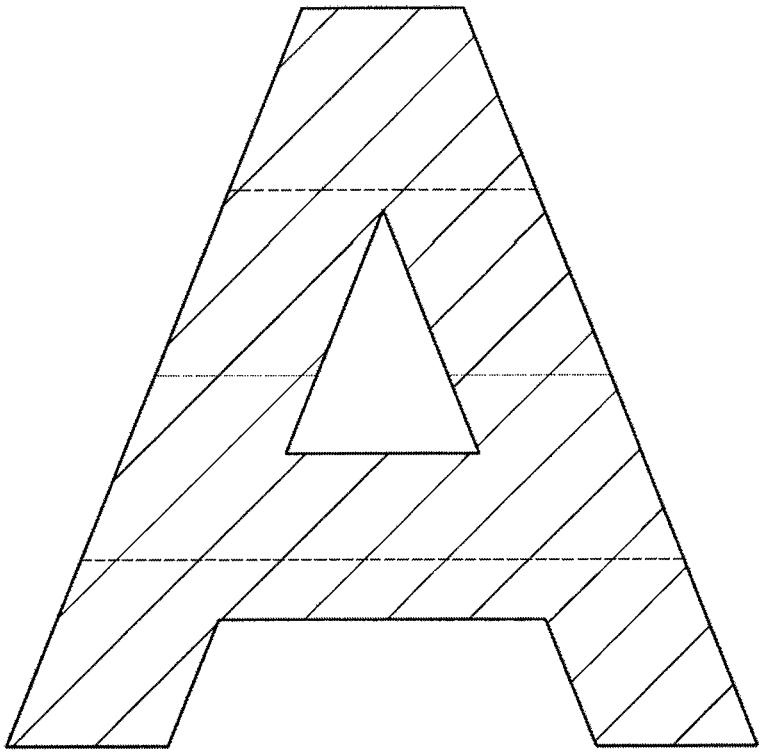

The example of dividing one-pass image recording into plural parts (for example, two parts) includes that, as illustrated in FIG. 9A, the letter of "A" is divided into four parts separated along the vertical direction, ink is discharged from the head 21 with respect to two parts among the four parts in the first divided pass, and then ink is discharged from the head 21 with respect to the remaining two parts in the next second divided pass, thereby executing discharging of ink with respect to the letter of "A" separately in two times.

Accordingly, it is possible to execute the first mode and the second mode, without changing the one-pass discharge rate by the head 21, that is, the frequency at which ink is discharged from the head 21 or the movement speed of the head 21 in the main scanning direction.

Incidentally, instead of the change of the waiting time between passes, the division of one-pass image recording, or the like, the rate of ink to be discharged in one-pass image recording from the head 21 in each mode may be changed by changing the frequency at which ink is discharged from the head 21 or by changing the movement speed of the head 21 in the main scanning direction.

In the embodiment described above, the signal received from the installation sensor 154 is determined for each pass. Instead of this, for example, the signal received from the installation sensor 154 may be determined every image recording for one sheet or plural pages.

In addition, the temperature sensor 157 may not be provided and the third mode may not be set. That is, the first mode or the second mode may be set depending on whether the cartridge 200 is installed in the installation case 150.

Further, in the embodiment described above, the discharging of ink through the head 21 has been described as an example of image recording on a sheet. However, the discharging of ink through the head 21 may be a so-called purging by which ink is forcibly discharged from the nozzle 29 of the head 21.

In the embodiment described above, ink is exemplified as a liquid. However, the liquid may be, for example, a pretreatment liquid to be jetted on a sheet or the like prior to ink at the time of image recording, or water for cleaning the head 21.

According to the present disclosure, at least the following modes are provided.

(1) A liquid discharge device may include: an installation case installed with a cartridge including a first liquid chamber in which a liquid is stored, a first flow path in which one end thereof communicates with the first liquid chamber and the other end communicates with the outside, and a second flow path in which one end thereof communicates with the first liquid chamber and the other end communicates with the outside; a tank including a second liquid chamber, the tank including a third flow path in which one end thereof communicates with the outside and the other end communicates with the second liquid chamber, the third flow path forming a flow path, through which the first liquid chamber and the second liquid chamber communicate with each other when the cartridge is installed in the installation case, together with the first flow path, a fourth flow path in which one end thereof located below the third flow path communicates with the second liquid chamber, and a fifth flow path in which one end thereof communicates with the second liquid chamber and the other end communicates with the outside; a head that communicates with the other end of the fourth flow path; a valve that opens and closes the third flow path in conjunction with installation and uninstallation of the cartridge to the installation case; a installation sensor; and a controller, wherein the controller is configured to: determine whether a first signal outputted by the installation sensor in response to that the cartridge is not installed in the installation case or a second signal outputted by the installation sensor in response to that the cartridge is installed in the installation case is received; execute a first mode of discharging a liquid through the head at a first rate, in which a liquid discharge amount through the head per unit time is set to a first amount, in response to receiving the discharge instruction to discharge a liquid through the head and determining that the first signal is received; and execute a second mode of discharging a liquid through the head at a second rate, in which a liquid discharge amount through the head per unit time is set to a second amount larger than the first amount, in response to receiving the discharge instruction to discharge a liquid through the head and determining that the second signal is received.

According to the above-described configuration, in the state where the cartridge is installed in the installation case, while the air enters the first liquid chamber or the second liquid chamber through the second flow path and the fourth flow path as a liquid is discharged from the head, in the state where cartridge is not installed in the installation case, the air enters the second liquid chamber through the fourth flow path. At this time, since the liquid discharge rate from the head is set to the first rate according to the first mode, a risk that the amount of a liquid to be supplied to the head from the second liquid chamber is insufficient can be reduced.

(2) Preferably, the flow path resistance Rc against the air of the second flow path is smaller than the flow path resistance Rs against the air of the fourth flow path.

According to the above-described configuration, in the state where the cartridge is installed in the installation case, the air is likely to enter the first liquid chamber compared to the second liquid chamber as a liquid is discharged from the head. Therefore, since the liquid stored in the first liquid chamber is preferentially consumed, a risk that the air enters the head from the second liquid chamber can be reduced. Meanwhile, in the state where the cartridge is not installed in the installation case, since the air enters the second liquid chamber through large flow path resistance Rs as a liquid is discharged from the head, a risk that the liquid to be supplied to the head from the second liquid chamber is insufficient becomes high. However, according to the first mode, since the liquid discharge rate through the head is set to the first rate, the risk can be reduced.

(3) Preferably, each of the second flow path and the fourth flow path is closed with a semipermeable membrane which restricts passage of a liquid and permits passage of the air.

According to the above-described configuration, it is prevented that the liquid flows out to the outside from the second flow path and the fourth flow path.

(4) Preferably, the head discharges a liquid in one unit area with respect to a discharge target medium, and the controller is configured to cause the head to repeat the discharging of a liquid of the one unit area with a waiting time, with respect to the discharge target medium, to set the waiting time to a first time in the first mode, and to set the waiting time to a second time, which is shorter than the first time, in the second mode.

According to the above-described configuration, it is possible to execute the discharging at the first rate and the second rate without changing the discharge rate in one unit area by the head.

(5) Preferably, the head discharges a liquid in an amount corresponding to one unit area or a divided area, which is obtained by dividing the one unit area into plural portions, with respect to a discharge target medium, and the controller is configured to cause the head to repeat the discharging a liquid in an amount corresponding to one unit area or a divided area with respect to the discharge target medium, to cause the head to discharge a liquid in an amount corresponding to a divided area in the first mode, and to cause the head to discharge a liquid in an amount corresponding to one unit area in the second mode.

According to the above-described configuration, without changing the discharge rate in one unit area by the head, it is possible to execute the discharging at the first rate and the second rate.

(6) Preferably, the controller is configured to determine whether the first signal or the second signal is received from the installation sensor whenever executing discharging a liquid per the unit time.

According to the above-described configuration, since it is possible to change the mode for each unit time, when the cartridge is installed in the installation case in the middle of discharging a liquid from the head, it is possible to generally improve the liquid discharge rate by changing the mode from the first mode to the second mode.

(7) Preferably, the liquid discharge device further includes a temperature sensor, and the controller is configured to execute the first mode and the second mode under a condition that a signal received from the temperature sensor is equal to or more than a threshold, and to execute a third mode of discharging a liquid through the head at a third rate, in which the liquid discharge amount per unit time through the head is set to a third amount smaller than the first amount, in response to determining that the second signal is received under a condition that the signal received from the temperature sensor is less than the threshold.

According to the above-described configuration, it is possible to detect a change in temperature by the temperature sensor at the environment where the liquid discharge device is installed. If the temperature at the environment is lowered, the fluidity of the air and liquid deteriorates. As a result, a risk that the amount of a liquid to be supplied to the head from the second liquid chamber is insufficient becomes high. According to the third mode, the liquid discharge rate through the head is set to the third rate, thereby reducing the risk that the amount of a liquid to be supplied to the head from the second liquid chamber is insufficient.

According to the present disclosure, even if no cartridge is installed, the supply of ink to the head is satisfactorily realized.

What is claimed is:

1. A liquid discharge device comprising:

an installation case configured to receive a cartridge, the cartridge comprising:

a first liquid chamber storing a liquid;

a first flow path, one end of the first flow path communicated with the first liquid chamber, the other end of the first flow path communicated with an outside of the cartridge; and a second flow path, one end of the second flow path communicated with the first liquid chamber, the other end of the second flow path communicated with the outside of the cartridge;

a tank including a second liquid chamber, the tank comprising:

a third flow path, one end of the third flow path communicated with the outside of the tank, the other end of the third flow path communicated with the second liquid chamber, at least one of the first flow path and the third flow path configured to communicate with the first liquid chamber of the cartridge installed in the installation case and the second liquid chamber;

a fourth flow path, one end of the fourth flow path located below the third flow path communicated with the second liquid chamber; and a fifth flow path, one end of the fifth flow path communicated with the second liquid chamber, the other end of the fifth flow path communicated with the outside of the tank;

a head communicated with the other end of the fourth flow path;

an installation sensor; and a controller configured to:

determine whether one of a first signal and a second signal is received from the installation sensor, the first signal indicating that the cartridge is not installed in the installation case, the second signal indicating that the cartridge is installed in the installation case;

execute a first mode of discharging a liquid through the head, in which a liquid discharge amount through the head per unit time is a first amount in the first mode, based on receiving the discharge instruction to discharge a liquid through the head and determining that the first signal is received; and execute a second mode of discharging a liquid through the head, in which a liquid discharge amount through the head per unit time is a second amount larger than the first amount, based on receiving the discharge instruction to discharge a liquid through the head and determining that the second signal is received.

2. The liquid discharge device according to claim 1, wherein flow path resistance Rc against the air of the second flow path is smaller than flow path resistance Rs against the air of the fifth flow path.

3. The liquid discharge device according to claim 2, wherein each of the second flow path and the fourth flow path is closed with a semipermeable membrane which restricts passage of a liquid and permits passage of the air.

4. The liquid discharge device according to claim 1, wherein the head discharges a liquid in one unit area with respect to a discharge target medium, and wherein the controller is configured to:

control the head to repeat the discharging of a liquid in one unit area having a waiting time with respect to the discharge target medium;

set the waiting time to a first time in a first mode; and set the waiting time to a second time, which is shorter than the first time, in a second mode.

5. The liquid discharge device according to claim 1, wherein the head discharges a liquid in one unit area or a divided area, which is obtained by dividing the one unit area into plural parts, with respect to a discharge target medium, and wherein the controller is configured to:

control the head to repeat the discharging of a liquid in one unit area or a divided area with respect to the discharge target medium;

control the head to execute the discharging of a liquid in a divided area in a first mode; and control the head to execute the discharging of a liquid in one unit area in a second mode.

6. The liquid discharge device according to claim 1, wherein the controller is configured to determine whether the first signal or the second signal is received from the installation sensor whenever executing discharging a liquid per the unit time.

7. The liquid discharge device according to claim 1, further comprising:

a temperature sensor, wherein the controller is configured to:

execute the first mode and the second mode under a condition that a signal received from the temperature sensor is equal to or more than a threshold; and execute a third mode of discharging a liquid through the head, in which the liquid discharge amount per unit time through the head is a third amount smaller than the first amount, in response to determining that the second signal is received under a condition that the signal received from the temperature sensor is less than the threshold.

* * * * *